United States Patent [19]

Buckingham

[11] Patent Number: 5,052,460

[45] Date of Patent: Oct. 1, 1991

[54] VENETIAN BLIND RESTRAINER APPARATUS

[76] Inventor: Lewis D. Buckingham, 2350 W. First St., Apt. 701, Ft. Myers, Fla. 33901

[21] Appl. No.: 470,374

[22] Filed: Jan. 25, 1990

[51] Int. Cl.[5] ..... E06B 9/30

[52] U.S. Cl. ..... 160/178.1; 160/349.1

[58] Field of Search ..... 160/178.1, 349.1, 349.2, 160/166.1, 172; 24/702, 684; 248/297.5, 297.3, 316.4, 231.4

[56] References Cited

U.S. PATENT DOCUMENTS

| | | | |
|---|---|---|---|
| 1,894,730 | 1/1933 | Burns | 160/178.1 |
| 2,298,892 | 10/1942 | Lorentzen | 160/178.1 |
| 2,901,035 | 8/1959 | Anderle | 160/178.1 |
| 3,447,586 | 6/1969 | Anderle | 160/178.1 |

FOREIGN PATENT DOCUMENTS

| | | | |
|---|---|---|---|
| 226708 | 4/1959 | Australia | 160/178.1 |

*Primary Examiner*—Blair M. Johnson

*Attorney, Agent, or Firm*—Leon Gilden

[57] ABSTRACT

An apparatus is set forth wherein an elongate plate member includes a flange orthogonally mounted to a rear top edge of the plate member. The plate member includes an arcuate forward nose positioned downwardly relative to the flange, with an elongate slot directed rearwardly of a bottom edge of the plate member towards the flange. Modifications include the forward nose mounted upon a separate member pivotally mounted to the plate member to enable adjustment of the forward nose accommodating variations in venetian blind height. A further modification includes a threadedly mounted resilient conical anchor member mounted through the plate member orthogonally thereto to frictionally engage side portions of a venetian blind assembly.

1 Claim, 4 Drawing Sheets

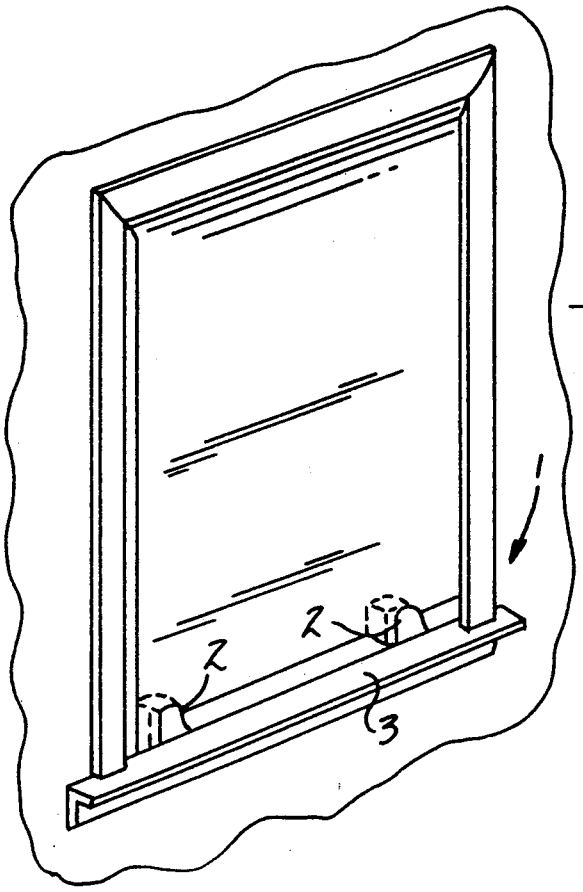
Fig 1
PRIOR ART
Fig 2
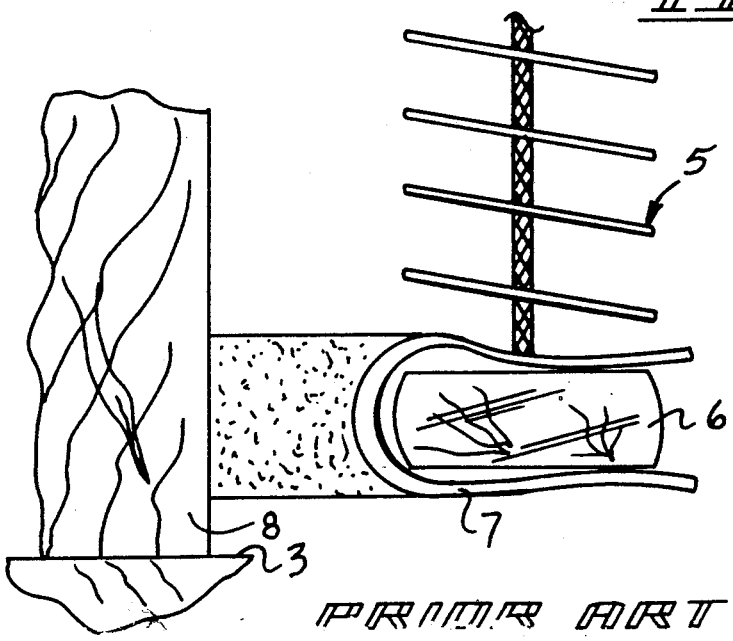
PRIOR ART

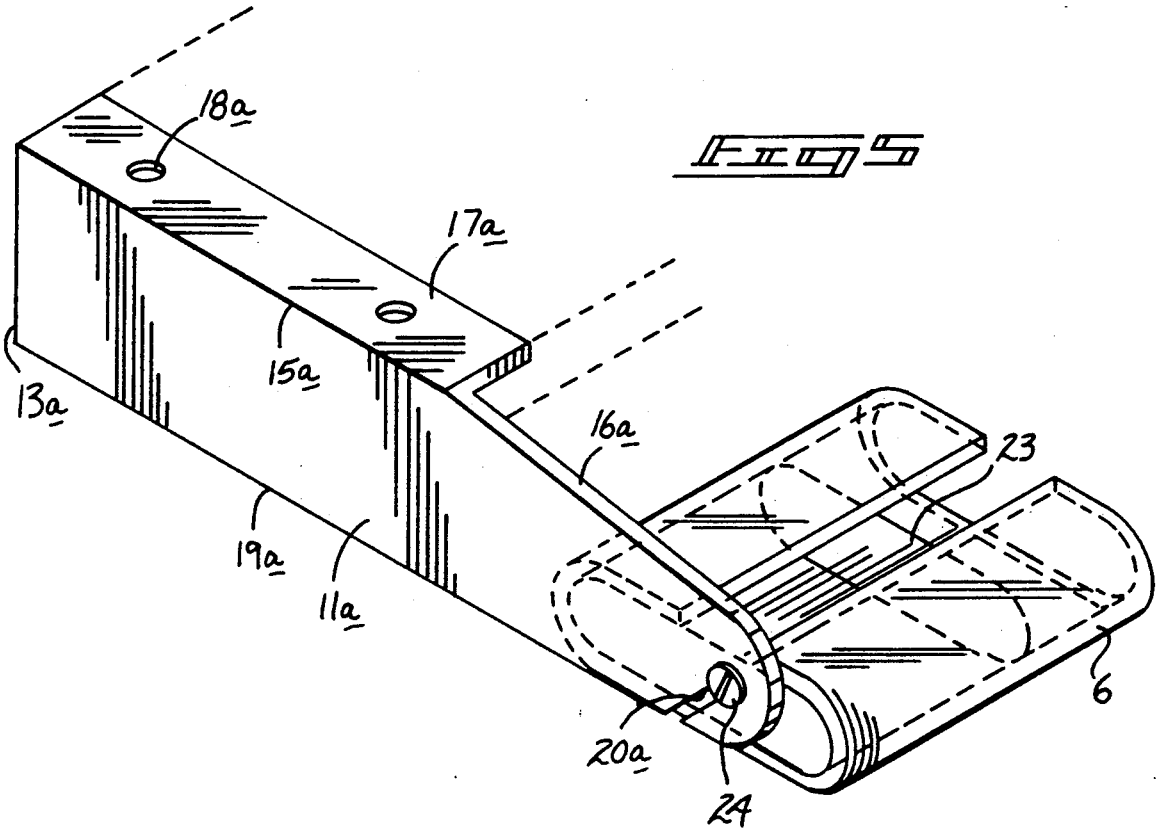
Fig 5
Fig 6
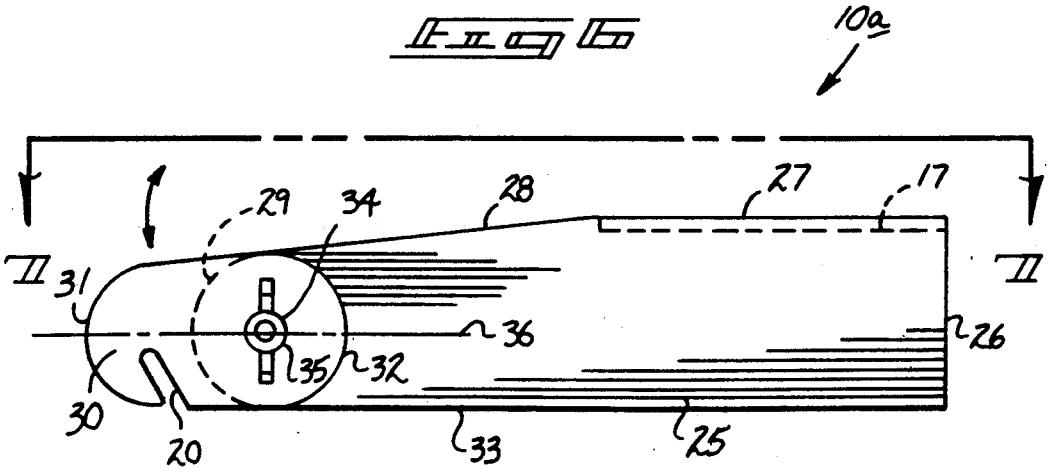

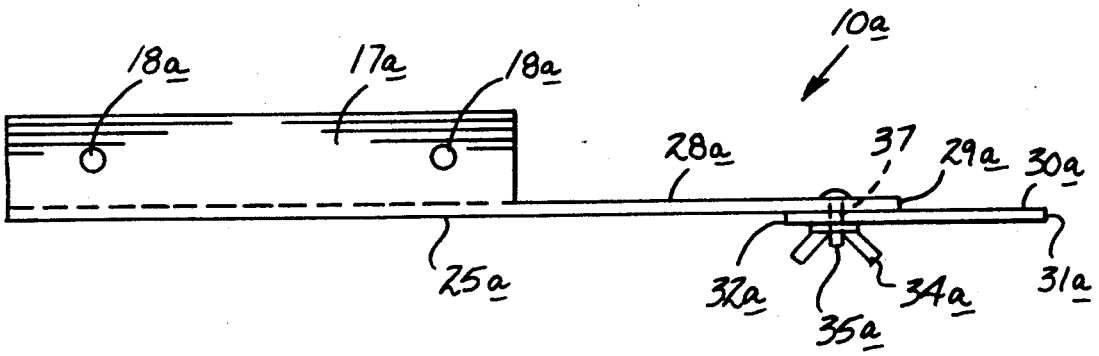
FIG 7
FIG 8
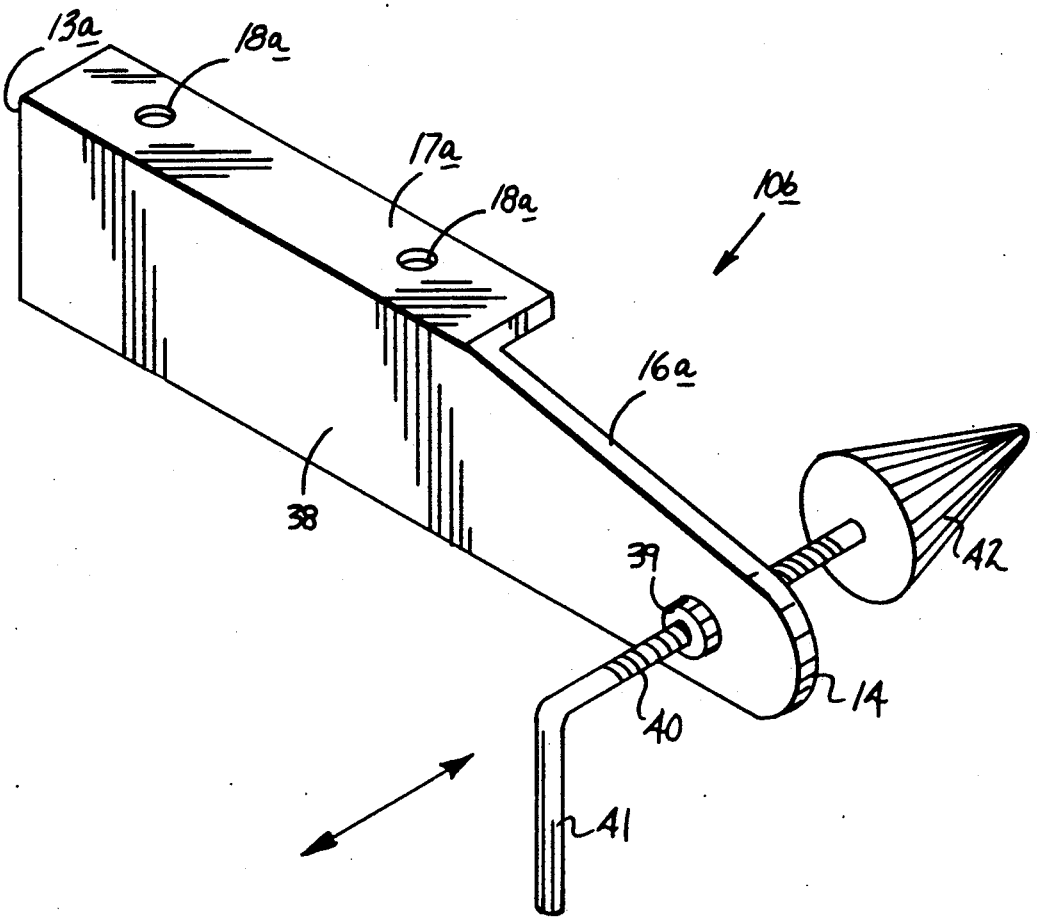

VENETIAN BLIND RESTRAINER APPARATUS

BACKGROUND OF THE INVENTION

1. Field of the Invention

The field of invention relates to venetian blind securement apparatus, and more particularly pertains to a new and improved venetian blind restraint apparatus wherein the same positions a venetian blind assembly at a predetermined orientation relative to a window sill portion of an associated window.

2. Description of the Prior Art

Venetian blinds in use frequently are afforded a disadvantage of vibration and swaying subject to wind and traffic conditions within a room the venetian blinds are mounted within. The venetian blinds, during such movement, will create undesirable noise, as well as a marring undesirable marking of an adjacent wall associated with the window assembly. Prior art organizations to address this problem have been available in the prior art, but have been of a relatively complex and awkward construction, as opposed to that of the instant invention. Examples of the prior art include U.S. Pat. No. 4,088,173 to Antich wherein the same utilizes spaced spring finger members of a generally "U" shaped configuration to receive a lowermost edge of a blind therewithin. The invention further as defined by the patent includes the "U" shaped spring fingers orthogonally mounted to a vertical frame portion of an associated window to receive engageably therewithin a lowermost frame portion of the venetian blind assembly.

U.S. Pat. No. 4,779,661 to Yalowega utilizes a plurality of spaced "L" shaped members mounted within a bracket to secure additional vanes of a vertical blind arrangement overlying a window.

U.S. Pat. No. 3,159,864 to Ferrera utilizes a looped member encompassing a base bar of an associated venetian blind assembly, with a roller mounted at a forward end of the bracket to enable reciprocation of the base bar relative to an associated window.

U.S. Pat. No. 4,696,336 to Dixon sets forth a chain attachment for a vertical blind assembly, with a plurality of plastic clips mounted at spaced intervals to the chain to enable securement of lowermost terminal ends of the vertical blind assembly together.

Accordingly, it may be appreciated that there is a continuing need for a new and improved venetian blind restrainer apparatus wherein the same addresses both the problems of ease of use and effectiveness in construction in positioning and maintaining a venetian blind assembly at a predetermined orientation relative to an associated window, and in this respect, the present invention substantially fulfills this need.

SUMMARY OF THE INVENTION

In view of the foregoing disadvantages inherent in the known types of venetian blind securement apparatus now present in the prior art, the present invention provides a venetian blind restrainer apparatus wherein the same positions and mounts to a window sill and an associated venetian blind base bar to secure and maintain a venetian blind at a predetermined orientation relative to a window assembly. As such, the general purpose of the present invention, which will be described subsequently in greater detail, is to provide a new and improved venetian blind restrainer apparatus which has all the advantages of the prior art venetian blind securement apparatus and none of the disadvantages.

To attain this, the present invention provides an apparatus wherein an elongate plate member includes a flange orthogonally mounted to a rear top edge of the plate member. The plate member includes an arcuate forward nose positioned downwardly relative to the flange, with an elongate slot directed rearwardly of a bottom edge of the plate member towards the flange. Modifications include the forward nose mounted upon a separate member pivotally mounted to the plate member to enable adjustment of the forward nose accommodating variations in venetian blind height. A further modification includes a threadedly mounted resilient conical anchor member mounted through the plate member orthogonally thereto to frictionally engage side portions of a venetian blind assembly.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved venetian blind restrainer apparatus which has all the advantages of the prior art venetian blind securement apparatus and none of the disadvantages.

It is another object of the present invention to provide a new and improved venetian blind restrainer apparatus which may be easily and efficiently manufactured and marketed.

It is a further object of the present invention to provide a new and improved venetian blind restrainer apparatus which is of a durable and reliable construction.

An even further object of the present invention is to provide a new and improved venetian blind restrainer apparatus which is susceptible of a low cost of manufacture with regard to both materials and labor, and which accordingly is then susceptible of low prices of sale to the consuming public, thereby making such venetian blind restrainer apparatus economically available to the buying public.

Still yet another object of the present invention is to provide a new and improved venetian blind restrainer apparatus which provides in the apparatuses and methods of the prior art some of the advantages thereof, while simultaneously overcoming some of the disadvantages normally associated therewith.

Still another object of the present invention is to provide a new and improved venetian blind restrainer apparatus wherein the same is readily securable to a window sill of an associated window to position and orient a base bar and associated venetian blind assembly at a predetermined spacing relative to an associated window.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art window shade securement apparatus, FIG. 2 is an orthographic side view taken in elevation of a prior art venetian blind restrainer apparatus.

FIG. 5 is an isometric illustration of the right bracket utilized by the instant invention is association with a venetian blind base bar.

FIG. 6 is an orthographic side view taken in elevation of a modified venetian blind restrainer apparatus utilized by the instant invention.

FIG. 7 is a top orthographic view of a further bracket of the modified venetian blind restrainer apparatus, as illustrated in FIG. 6.

FIG. 8 is an isometric illustration of a further modification of the venetian blind restrainer apparatus utilized by the instant invention.

DESCRIPTION OF THE PREFERRED EMBODIMENT

Figure 3:
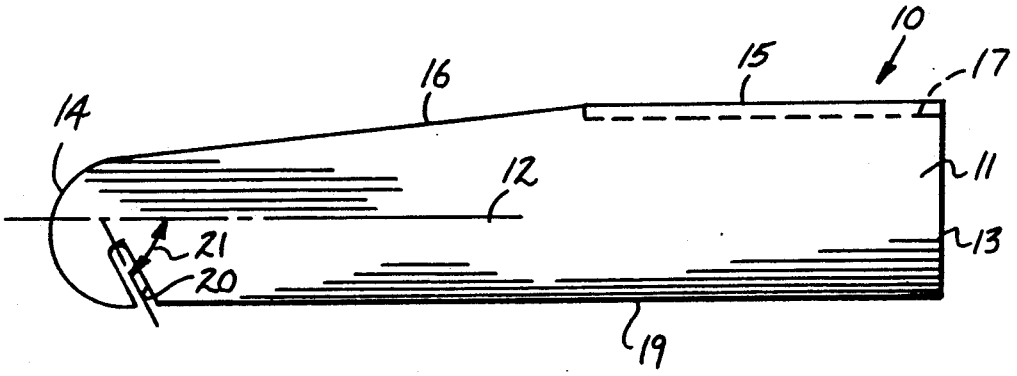
FIG. 3 is an orthographic exterior side view of the left bracket member of the instant invention.
Figure 4:
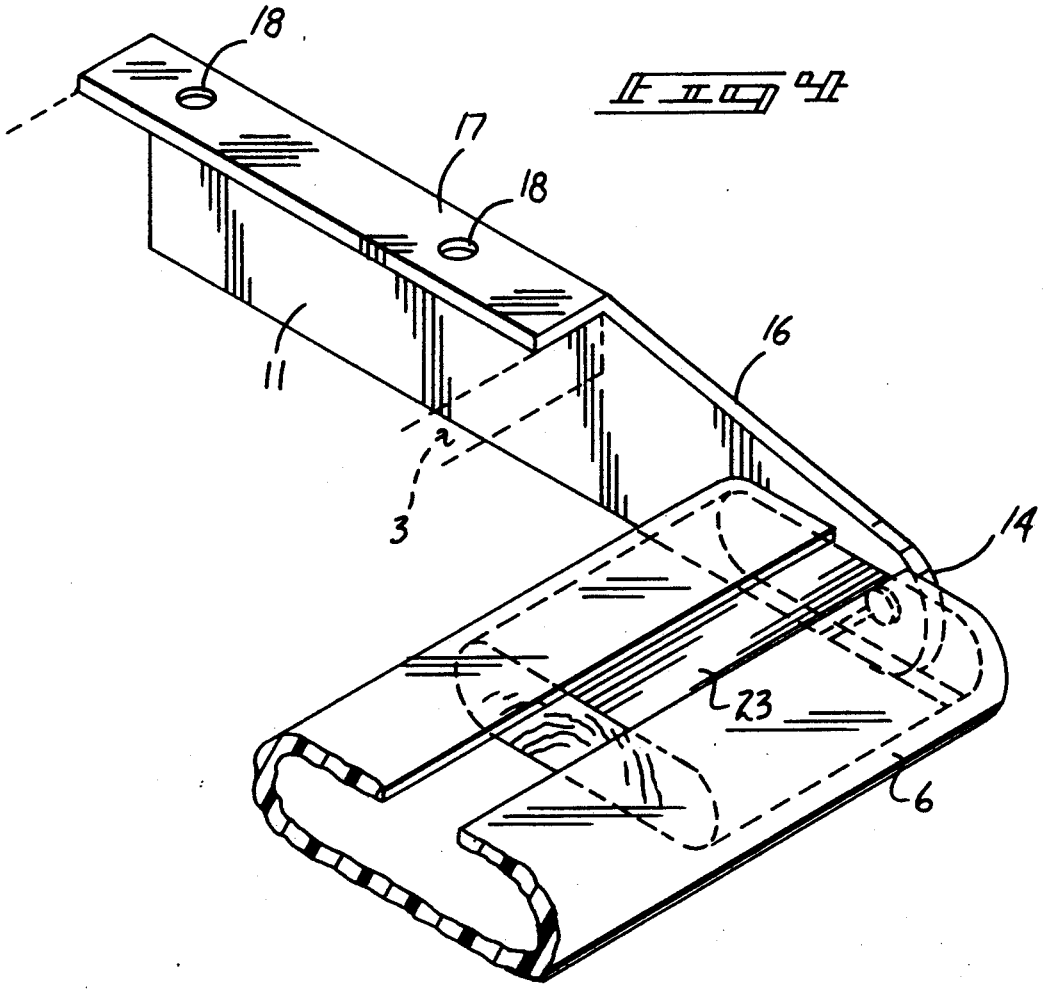
FIG. 4 is an isometric illustration of the left bracket member of the instant invention in association with a venetian blind base bar.

With reference now to the drawings, and in particular to FIGS. 1 to 8 thereof, a new and improved venetian blind restrainer apparatus embodying the principles and concepts of the present invention and generally designated by the reference numerals 10, 10*a*, and 10*b* will be described.

FIG. 1 is illustrative of a prior art venetian blind restrainer assembly 1 utilizing a plurality of spaced "U" shaped brackets 2 to position a reciprocating flexible shade adjacent a window sill 3. FIG. 2 illustrates a further usage of the organization of FIG. 1, wherein the "U" shaped brackets 7 are mounted to a base member to position a base bar 6 of a venetian blind assembly 5 in a spaced relationship relative to a vertical frame member 8 of an associated window.

More specifically, the venetian blind restrainer apparatus 10 of the instant invention essentially comprises an elongate plate member 11 defined about a central longitudinal axis 12. The plate includes a rear edge 13 oriented orthogonally relative to the longitudinal axis 12 for positioning and anchoring of the plate against an associated wall surface. The plate includes an arcuate forward edge 14 to minimize obstruction and injury upon inadvertent contact by an individual with the forward edge. A top edge is defined by a rear top edge portion 15 aligned generally orthogonally relative to the rear edge 13, with a flange member 17 mounted orthogonally relative to the rear top edge 15 and coextensive therewith. A forward top edge 16 is directed downwardly from the rear top edge 15 towards the arcuate forward edge 14. The flange 17 is formed with spaced apertures 18 for reception of fastener elements (not shown) through the apertures into an associated window sill member 3 to secure the plate thereto. A bottom edge 19 is arranged generally parallel relative to the longitudinal axis 12 and the rear top edge 15 and spaced therefrom and coextensive with the plate 11. A slot 20 is directed upwardly and forwardly of the bottom edge 19 and defines an acute angle 21 defined between the slot 20 and the longitudinal axis 12, with the predetermined length of the slot 20 less than that defined between the longitudinal axis 12 and the bottom edge 19. In use, the plate 11 is utilized with a further plate 11*a* (see FIG. 5) to provide a spaced pair of such plate members 11 and 11*a* for use with an associated window sill 3. The right and left plate members are mirror images of one another, wherein the right plate member 11*a* is defined by a bottom edge 19*a*, a rear edge 13*a*, a flange 17*a* formed with apertures 18*a* therethrough. The top forward edge 16*a* is directed forwardly to an arcuate forward nose with a slot 20*a* formed therewithin. A positioning lug 24 is directed through the slot 20 and 20*a* of each associated plate member and is directed through the slot and received within a plug 23 mounted within the base bar 6 of an associated venetian blind assembly. Mounting the base bar 6 in the illustrated orientation relative to FIGS. 4 and 5 in a spaced relationship relative to a window sill 3 prevents any unnecessary and undesirable movement of the venetian blind assembly relative to an associated window.

FIGS. 6 and 7 illustrate a modified venetian blind restrainer apparatus 10*a*, including an elongate modified plate member 25 pivotally mounting a positioning plate about a forward end thereof. The positioning plate 25 includes a rear edge 26 orthogonally aligned with a longitudinal axis of the plate 25, with a rear top edge 27 mounting the flange 17 and its associated apertures 18 thereto. The elongate plate 25 is formed with a forward top edge 28 directed downwardly from the rear top edge 27 to a forward arcuate nose 29 mounting the positioning plate 30. The positioning plate 30 includes a forward arcuate plate nose 31 and a rear arcuate plate nose 32 defining a diameter substantially equal to that of a width of the plate 25 at the pivotment of the positioning plate 30 by use of a wing nut 34 mounted to a threaded fastener lug 35. In this manner, the positioning plate 30 does not provide any projecting edges beyond the forward top edge 20 and the bottom edge 33 of the plate 25. The plate 25 is a left plate defining a mirror image of a right plate 25*a* formed with parallel structure, as illustrated in FIG. 7, with a flange 17*a* formed with apertures 18*a* therethrough, a forward top edge 28*a* directed downwardly from the flange 17*a* to a forward arcuate nose 29. The positioning plate 31*a* is formed with a rear arcuate plate nose edge 32*a* directed rearwardly from a forward arcuate plate nose 31, with a wing nut 34*a* mounting a threaded fastener lug 35 about which the positioning plate 31*a* rotates. Aligned bores 37 directed through the positioning plate 31 and an associated plate 25, as well as the respective plate 25*a* and positioning plate 31*a*, receives the threaded fastener lug 35 and 35*a* respectively therethrough.

FIG. 8 illustrates the right member of a further pair of plate members to be utilized in positioning a venetian blind assembly, wherein a plate 38 includes an internally threaded boss 39 mounted orthogonally and rearwardly of the arcuate forward edge 14 of the plate 38. The boss 39 threadedly receives an externally threaded rod 40 therethrough that is formed with an offset handle 41 at a rear end thereof, and an elastomeric conical anchor member 42 that is coaxially and integrally mounted to a forward end of the threaded rod 40. The anchor member 42 may be forcibly and deformably directed against the plug 23 within the base bar 6 of a venetian blind assembly to secure the venetian blind assembly relative to the plate structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A venetian blind restrainer apparatus for securement to a window sill to secure and position an elongate base bar of a venetian blind assembly in a spaced relationship relative to the window sill, the apparatus comprising, a first elongate plate member and a second elongate plate member for mounting to each side edge of the window sill, and each plate member including a slot adjacent a forward edge of each plate member to receive a positioning lug therewithin, the positioning lug mounted and extending exteriorly of each end of the base bar of the venetian blind assembly, and wherein each plate member includes a longitudinal axis positioned medially of each plate member between a bottom edge and a rear top edge, and a rear edge formed on each plate member oriented orthogonally relative to each longitudinal axis, and the bottom edge oriented orthogonally relative to the rear edge of each plate members with a top edge of each plate member spaced from the bottom edge and defined by the rear top edge spaced in a parallel relationship relative to the bottom edge and intersecting the rear edge, and the top edge including a forward top edge directed downwardly from the rear top edge to the forward edge of each plate member, and each slot of each plate member directed into the plate member from each bottom edge of each plate member and terminating below each longitudinal axis of each plate member, and wherein each slot defines an acute angle between the slot and each longitudinal axis, and each slot directed from the bottom edge towards the forward edge of each plate member, and wherein each plate member includes a flange mounted and integrally formed orthogonally to the rear top edge of each plate member, wherein each flange includes a plurality of mounting apertures directed therethrough to mount the flange to the window sill, and wherein each slot is mounted within a positioning plate, and each positioning plate is pivotally mounted to each elongate plate member, the positioning plate defined by a forward arcuate plate nose and a rear arcuate plate edge, the rear arcuate plate edge defining a diameter substantially equal to the width of each plate member, at the point of pivotal attachment and each positioning plate mounted to each plate member including a threaded lug and a threaded fastening member sandwiching the positioning plate and plate member therebetween.

* * * * *